United States Patent [19]

Form

[11] Patent Number: 4,827,412

[45] Date of Patent: May 2, 1989

[54] PINFALL DETECTOR USING VIDEO CAMERA

[75] Inventor: Michael A. Form, Southborough, Mass.

[73] Assignee: Computer Sports Systems, Inc., Cambridge, Mass.

[21] Appl. No.: 823,591

[22] Filed: Jan. 29, 1986

[51] Int. Cl.[4] ..... A63D 5/04

[52] U.S. Cl. ..... 364/410; 273/54 E

[58] Field of Search ..... 364/410; 273/54 C, 54 E; 340/709; 358/108

[56] References Cited

U.S. PATENT DOCUMENTS

| | | | |
|---|---|---|---|
| 3,140,872 | 7/1964 | Bolger, Jr. | 273/54 E |
| 3,307,848 | 3/1967 | Brackett et al. | 273/54 E |
| 3,408,485 | 10/1968 | Scott et al. | 377/10 |
| 3,847,394 | 11/1974 | Logemann, Jr. et al. | 273/54 E |
| 4,148,481 | 4/1979 | Smith-Vaniz | 273/54 E |
| 4,198,653 | 4/1980 | Kamin | 358/108 X |
| 4,249,207 | 2/1981 | Harman et al. | 358/108 |
| 4,458,266 | 7/1984 | Mahoney | 358/108 X |
| 4,490,851 | 12/1984 | Gerhart et al. | 382/43 |
| 4,497,066 | 1/1985 | Gasparri, Jr. | 382/48 |
| 4,539,703 | 9/1985 | Clearman et al. | 382/28 |
| 4,555,724 | 11/1985 | Enriquez | 358/93 |
| 4,566,000 | 1/1986 | Goldman et al. | 340/709 |
| 4,589,140 | 5/1986 | Bishop et al. | 382/8 |
| 4,629,189 | 12/1986 | Meniconi | 273/54 E |
| 4,658,428 | 4/1987 | Bedros | 382/30 |
| 4,688,939 | 8/1987 | Ray | 356/237 |

*Primary Examiner*—Clark A. Jablon

*Attorney, Agent, or Firm*—Wolf, Greenfield & Sacks

[57] ABSTRACT

Pinfall apparatus for the sport of bowling utilizes a digitized video picture of the pins to detect and count pins. A video camera is controlled by a microprocessor to take a "snapshot" of the pins which are illuminated by normal ambient light. The image is then digitized and stored as pixel values. During calibration of the system, additional parameters are stored which define memory addresses that correspond to potential pin locations. In addition, to minimize the effects of noise, a cutoff or threshold value is stored which determines the percentage of memory addresses calculated in accordance with the defined parameters which must be present for a pin to be standing in the predetermined location. The count is stored as a pin count. Later another "snapshot" is taken of pins which remain standing after a ball has been rolled and a pixed count determined as before. If the pixel count is greater than the stored pin count, then a pin is declared standing in the corresponding pin location. The process is repeated for each potential pin location.

12 Claims, 5 Drawing Sheets

PINFALL DETECTOR USING VIDEO CAMERA

FIELD OF THE INVENTION

This invention relates to apparatus for detecting pinfall in the sport of bowling.

BACKGROUND OF THE INVENTION

Apparatus for automatically setting pins and detecting pinfall has been in use for many years in bowling alleys. Pinfall counting apparatus is used to give a relatively rapid indication of the number and location of pins standing after a ball has been rolled. The output of the apparatus may be provided to an automatic scoring system or may simply be used to assist the bowler in determining his score since visibility of the pins themselves is often limited.

At first, pinfall detection apparatus was mechanical or electromechanical in nature and was often incorporated into the pinsetting mechanism. Such apparatus typically used mechanical "fingers" or scanning bars to physically contact each pin after the pins had been picked up by the pin setting machine between balls.

Such electromechanical apparatus presented practical problems in that it often required an accurate alignment to initially calibrate the apparatus so it would operate properly under a variety of conditions. Thus, skilled installation personnel were required. The apparatus also continually required detailed maintenance to ensure that the apparatus remained both in alignment and operated properly in the severe environment of a typical bowling alley which includes mechanical shock and dirt. Furthermore, the apparatus was slow. More specifically, in the case of a strike, it was necessary to cycle the pinsetting machine before the apparatus could make the determination that all pins had fallen. This extra cycle lengthened the amount of time required to finish a bowling "string" and thus reduced the profit of the bowling alley operator. Finally, the apparatus could not be easily retrofit to equipment which was not originally designed for such apparatus.

Accordingly, other prior art schemes have been developed to produce pinfall count which do not use electromechanical sensors which must physically contact the pins. Typically these latter schemes rely on "active" scanning in which the pins are scanned by a light beam or an ultrasonic acoustic beam. The pins which are standing are counted by a transducer or a set of transducers which sense the echo or reflection of the scanning beam from the standing pins.

As with the prior electromechanical devices, these "active" scanning arrangements typically require a fairly accurate fixed alignment of the scanner and transducers with respect to the pins. The accuracy in alignment requires that skilled personnel be used to initially calibrate the equipment and also requires constant maintenance and long repair times if the apparatus fails.

Accordingly, it is an object of the invention to provide pinfall detection apparatus which does not use an active scanning mechanism.

It is another object of the present invention to provide a pinfall detection system which uses ambient light to illuminate the pins.

It is a further object of the present invention to provide a pinfall detection system which can be quickly and accurately aligned by ordinary maintenance personnel without requiring a high degree of skill or a detailed knowledge of the apparatus.

It is yet a further object of the present invention to provide a pinfall detection system which does not require constant maintenance and long repair times.

It is still another object of the present invention to provide a pinfall detection system which uses an ordinary video camera to detect pin presence or absence.

It is yet another object of the present invention to provide a pinfall detection system which utilizes a microprocessor to process the video image developed by the video camera to automatically total pincount and determine placement of the pins that remain standing.

SUMMARY OF THE INVENTION

The foregoing objects are achieved and the foregoing problems are solved in one illustrative embodiment of the invention in which a microprocessor-controlled video camera forms an image of standing pins which are illuminated by ambient light. The analog output of the camera is converted into digital signals. The signals can be processed real-time or stored in a memory and processed later by digital image processing routines.

In one embodiment of the invention, a simplified processing routine is employed. During calibration of the system, a stored image of a full pin deck is displayed on a video monitor and an interactive graphical display is used to designate areas of the stored image which correspond to standing pin areas. The apparatus calculates and stores parameters which define memory addresses that correspond to potential pin locations. Then, to minimize the effects of noise, the microprocessor reads the memory in accordance with the stored parameters and, for each pin area, counts the number of stored pixel values above a predetermined threshold value. The pixel count is stored as a pin count for the corresponding pin area.

Subsequently, in order to determine the number of pins that remain standing after a ball has been rolled, an additional video "snapshot" is taken of the pin deck and stored. The microprocessor examines the memory in accordance with the stored address information to determine a new pixel count for each pin area. The new pixel count is compared to the stored pin count to determine whether a pin is standing in the corresponding pin area.

After the areas corresponding to all pins have been examined, the microprocessor totals the pin count and forwards the count to scoring apparatus.

More particularly, during the calibration procedure, a video image is formed of a full set of pins, digitized and stored in an image memory. The stored image is then displayed on a video monitor and a graphics program establishes a pin "window" by displaying a rectangular line-drawn box on the monitor screen, which box overlays the displayed pin deck image. The box is drawn by setting bits in a drawing memory which has an address corresponding to each address in the image memory. By entering appropriate commands to the system, installation personnel can adjust the size and screen placement of the box. The box is manipulated to place it over a representative portion of each pin image and the system microprocessor then stores the parameters of the box and its relative addresses in the drawing memory. The drawing memory addresses are later used to define the pin area in the image memory during actual pinfall detection.

A threshold value is empirically established during calibration to separate the "white" pin signal level from the "black" background level. This threshold value is used to reduce or eliminate the effects of background noise, such as smoke and haze, so that the system will operate accurately in the actual environment.

After the threshold level and a pin area have been determined for each pin, the microprocessor counts each pixel with a pin signal level and stores this count as a pin count for use during further processing. The pin count allows accurate pin detection even if a pin moves from its initial position.

DETAILED DESCRIPTION OF THE PREFERRED EMBODIMENT

Figure 1:
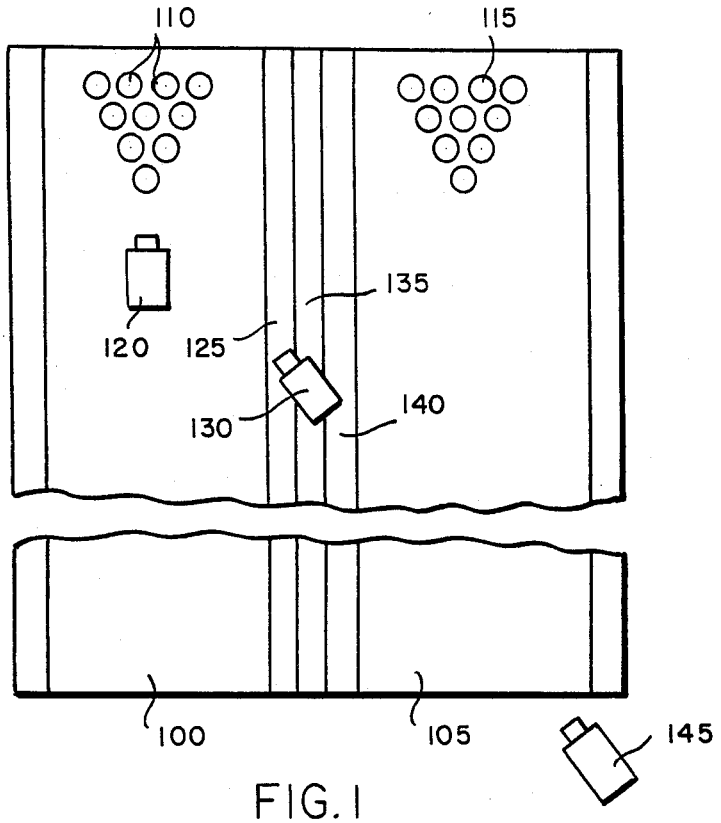
FIG. 1 is a schematic diagram of two bowling alleys showing three possible video camera locations for detecting pinfall in the left hand alley.

FIG. 1 is a schematic diagram of two bowling lanes 100 and 105 viewed from a overhead position. Each of lanes 100 and 105 has a conventional pin deck with a set of pins 110 and 115 located at the end of the lane. FIG. 1 shows three illustrative camera positions which could be used to view pin set 110. For example, the camera may be positioned in front of the pin deck (attached to the pin spotter equipment or to another convenient location) at position 120. Alternatively, the camera may illustratively be positioned at a position 130 between the gutter areas 125 and 140 as shown by camera position 130 or at an approach area to the side of the lane as shown by camera position 145. Generally, only one camera will be necessary for each lane. However, in some situations additional cameras may be necessary to insure that all pins can be readily detected. The second camera may be located in such a position that it views the pins from a different perspective to eliminate hidden pins. The position of the camera or cameras can be adapted to existing architecture and practical considerations, the only requirement being that the camera have a clear view of all pins. In order to obtain an adequate pin image, an appropriate camera lens must be used with a focal length that ensures an undistorted view of the pin deck from the camera placement position.

The analog video signal comprising the pin image developed by the camera is provided to video processing circuitry which will be hereinafter described in detail. In general, a video "snapshot" is taken of the pins. That is, the camera signal is gated on for a brief interval of time (approximately one frame time or 16 milliseconds). The video image signals are then converted to 4-bit digital words by a conventional "flash" type analog-to-digital converter and stored in a random access memory (RAM). The digital pixel values in the RAM are subsequently processed (as determined below) to determine the number of pins that remain standing.

Figure 2:
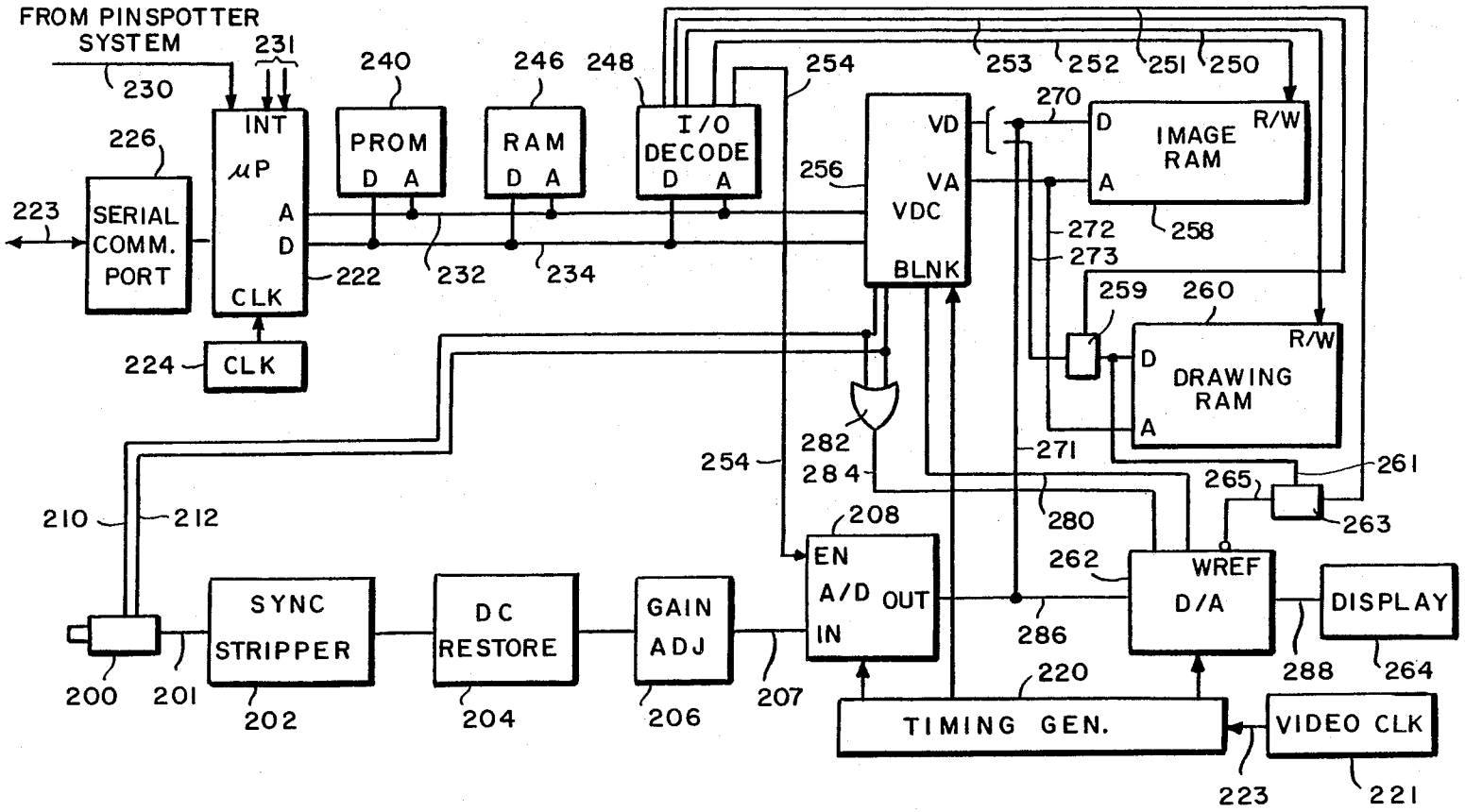
FIG. 2 is a block schematic diagram of the microprocessor and associated apparatus which detects and evaluates pinfall.

More specifically, FIG. 2 shows a block schematic diagram of the electronics which process the digital signal values to determine the pin count. The circuitry converts the analog signal produced by a video camera to digital signals and then processes the signals to make a determination of the number of pins standing.

Under control of clock signals from master clock 224, the operation of the entire circuit is controlled and coordinated by microprocessor 222. Microprocessor 222 also is used for communication with external systems such as a computerized scoring system. Microprocessor 222 may illustratively comprise a conventional microprocessor such as a Model 65F12 manufactured by Rockwell International Corporation, Semiconductor Products Division located in Newport Beach, Calif.

Microprocessor 222 can also communicate with external devices by means of serial communication port 226 using either a synchronous or an asynchronous communications protocol. Preferably, in accordance with conventional techniques, the serial communication port can communicate with the external environment over a noise-immune channel such as a balanced differential line or over a communication line which uses optically-coupled isolators. In addition, error checking techniques can be used to insure error-free operation in the highly noisy environment. Error checking and error recovery can be handled by conventional communication protocol software routines which run in microprocessor 222.

An additional input is provided to microprocessor 222 for a signal generated by pin spotter equipment (not shown) which indicates to microprocessor 222 the correct time at which to perform a pin count. Illustratively, this pin spotter signal is transmitted from the pin spotter equipment via lead 230 and applied to the interrupt input of microprocessor 222. Other well-known arrangements may also be used to connect the signal to microprocessor 222. In accordance with conventional programming techniques, such a signal can be used to initiate a interrupt routine which causes the microprocessor to perform a pinfall counting operation. Additional inputs 231 are also provided to microprocessor 222 for signals generated by pin spotter equipment which indicate whether the first or second ball is being rolled and whether the bowler has committed a foul during that frame. These inputs are provided to a conventional I/O port which is scanned by the microprocessor during the processing routines as described below.

Microprocessor 222 has several outputs, including address bus 232 and data bus 234. These busses are connected to memory units 240 and 246 and peripheral units 248 and 256. Although buses 232 and 234 are shown as single heavy lines, as is conventional, each bus actually consists of several wires, each of which carris a single bit signal. For clarity other buses are also shown as single wires although they also consist of multiple wires.

Memory unit 240 is a programmable read only memory (PROM) which contains control programs and other frequently-used routines which are run by microprocessor 222 to perform the operations necessary to calibrate the system and perform a pinfall count. Processor 222 also has access to a small external random access memory (RAM) 246 which is used to store temporary results and values used in the pinfall computation and communication routines.

The signals on address bus 232 and data bus 234 are also applied to input/output decoder circuit 248. In response to predetermined patterns of address signals, this latter circuit generates various enable and chip select signals which control the circuitry to perform several operations including capturing a video image, displaying a real time or stored image on display unit 264 or enabling video random access memories 258 and 260.

In order to "capture" a video image, video camera 200 forms an image of pins standing on the pin deck. Camera 200 may be one of a variety of conventional camera types including vidicons or CCD cameras. All of the aforementioned cameras develop an analog signal which is representative of the light intensity of the image A camera which is suitable for use with the illustrative embodiment is a model WV1500 manufactured by Panasonic, Inc. Located at 1 Panasonic Way, Secaucus, N.J. Camera 200 receives horizontal and video synchronization circuits, via coaxial leads 210 and 212, from video display controller (VDC) circuit 256. VDC circuit 256 is a conventional integrated circuit chip which receives clock signals at the pixel rate and generates various timing and address signals. VDC 256 will be described in more detail hereinafter.

The analog video signals developed by camera 200 provided, via coaxial lead 201, to a synchronization signal stripper circuit 202. Circuit 202 is also a conventional circuit which removes the synchronization pulses from the video signal leaving the analog video signal. The synchronization pulses must be removed because they have large amplitudes and it is desirable to utilize the entire dynamic range of the analog to digital converter 208 for processing the video signals.

From sync stripper 202, the analog signals are provided to D.C. restoration circuit 204. D.C. restoration circuit is a conventional D.C. voltage level shifter which is used to shift the relative D.C. levels of the signal to adjust the signal to a reference level which defines a known "black level". The operation and construction of the sync stripper circuitry 202 and D.C. restoration circuitry 204 is well-known to those in the art and will not be described further in detail.

The output of D.C. restoration circuit 204 is provided to gain adjust circuit 206 which provides scaling and gain adjustment to ensure that the peak-to-peak signal level covers the full dynamic range of the following analog to digital converter.

The output 207 of gain adjust circuit 206 is provided to the input of analog-to-digital converter 208. Converter 208 is a conventional coversion circuit of the "flash" type. An illustrative example of such a circuit is model MP7682 manufactured by Micro Power Systems located at 3100 Alfred Street, Santa Clara, Calif. This circuit converts an analog signal at its input into a four-bit digital signal. Converter 208 is controlled to perform a conversion by a timing signal provided by timing generator circuit 220 on lead 209 after the circuit has been enabled by an enable signal provided on lead 254 from I/O decode circuit 248. In particular, converter 208 is controlled by microprocessor 222 which generates a predetermined address pattern on its address bus 232 to select converter 208. This latter address pattern is decoded by decoder circuit 248 which applies an enable signal on lead 254 to enable converter 208.

Converter 208 actually starts a conversion under control of a timing signal from generator 220. After a short conversion delay, a four-bit digital signal is generated at output bus 286. The four-bit digital output value on bus 286 represents the brightness of the pin set image at the point of the conversion. Thus, a conversion is done for each point or pixel along each horizontal scan line.

In order to align camera 200 during the initial calibration of the system, the output of converter 208 can be provided on bus 286 directly to a digital-to-analog converter 262. Converter 262 is a conventional, high-speed, video, four-bit digital-to-analog converter, which under control of timing generator 220, and timing signals generated by VDC circuit 256, converts four-bit digital signals into an analog signal. In accordance with the well-known operation of video digital-to-analog converters, the analog signal generated at output 288 is a standard composite video signal which incorporates the synchronization signals generated by VDC 256 (as discussed below) as well as an analog signal representative of the digital image value. The composite digital signal is provided to display monitor 264 for immediate viewing of the signals developed by camera 200. A digital-to-analog converter suitable for use with the present embodiment is a Model BT102 manufactured by the Brooktree Corporation, 11175 Flintkote Avenue, San Diego, Calif.

In addition, converter 262 has a control input called the "white reference" input (WREF*, the asterisk indicates that a logical "low" signal is active). This input has the characteristic that a logical "0" signal provided to it will override the signals provided to the data inputs and cause the output to become a "white" video signal. This input is used to "OR" the outputs of the drawing RAM and the image RAM to overlay the windows on the pin deck image. More particularly, RAM 260 has two registers, 259 and 263 associated with it. Under control of I/O decoder 248, these registers are used to control the flow of data to and from the memory. Register 259 is enabled by signals on lead 253 to transfer data from VDC 256 over bus 273 to drawing RAM 260. Alternatively, register 263 is enabled by signals on lead 251 to transfer data (the least significant bit of the RAM 260 data bits) from RAM 260 to the WREF* input of digital-to-analog converter 262 over lines 261 and 265 during the window display routine.

The digital signals on the output of analog-to-digital converter 208 can also be provided, via four-bit video data buses 271 and 270 to image RAM 258 where the digital pixel values can be stored under control of address signals provided on video address bus 272 from video display controller (VDC) circuit 256.

VDC circuit 256 is a well-known circuit which generates the synchronization and address signals necessary to control video RAMs 258 and 260 and video camera 200. These signals include the horizontal and vertical television synchronization signals necessary for synchronizing camera 200 and for providing to digital-to-analog converter 262, a blanking signal (generated on lead 280 for incorporation into the composite video output generated by digital to analog converter 262), and address signals generated on bus 272 for controlling memories 258 and 260. VDC 256 also has a data bus output which can supply data to RAMs 258 and 260. The data bus output is a 16-bit bus. Eight bits of this bus are provided over bus 270 to the data input of RAM 258 and over buses 271 and 286 to the data inputs of digital-to-analog converter 262. The remaining eight bits are forwarded to drawing RAM 260 over bus 271. In the illustrative embodiment a VDC circuit which may be used is a Model 7220A manufactured by NEC Electronics located at 401 Ellis St., Mountain View, Calif. VDC unit 256 is controlled by parameters passed to the controller over data bus 234 from microprocessor 222. Typical parameters specify scan rates and raster dimensions for camera 200.

The video display controller 256 coordinates camera 200 by means of horizontal and video synchronization circuits on leads 210 and 212 and digital to analog converter 262 by means of a blanking signal on lead 280 and horizontal and vertical synchronization circuits on leads 210 and 212. The latter signals are ORed together by OR gate 282 and the resulting synchronization signal on lead 284 is applied to digital-to-analog converter 262. In addition, video display circuit 256 generates the address signals which are necessary to initialize and draw a video box cursor in drawing RAM.

Under control of address signals generated by VDC 256, image RAM 258 stores the four-bit pixel values which are generated by analog-to-digital converter 208 from the video signal generated by camera 200. Image RAM 258 can also be read by microprocessor 222, via video data bus 270, through VDC 256. Pixel information stored in image RAM 256 can be transferred, via buses 270 and 286, to digital-to-analog converter 262 to be displayed on display unit 264.

Drawing RAM 260 can also be controlled by VDC 256 via address signals on bus 272. Drawing RAM 260 is identical to image RAM 258 and has a corresponding memory location for each location of image RAM 258. In addition, the same address bus connecting RAM 258 to VDC 256 also connects RAM 260 to VDC so that as pixel locations in RAM 258 are accessed by VDC 256, the same pixel locations can be accessed simultaneously in RAM 260. As previously mentioned, drawing RAM is controlled by microprocessor 222, via VDC 256, to store video cursor windows or "boxes" on the video display unit 264 during the system calibration process. In particular, microprocessor 222 stores a plurlity of 1-bit "on/off" picture dots comprising a box outline in memory 260. The box outlines are "overlayed" onto a digitized image which is either retrieved from image RAM 258 or generated by converter 208 by digital-to-analog converter 262 which "OR"s the box and image signals prior to display.

The address values for both image and drawing RAMs 258 and 260 corresponding to the location and size of the window box are also stored in external RAM 246 by microprocessor 222 for subsequent processing operations to determine pinfall. As previously described, once the window addresses are defined and stored in external RAM 246, microprocessor 222 can easily calculate the addresses which correspond to image points lying within the window area on the display screen and, thus, may read image RAM 258 pixel values at the image RAM locations within the window locations stored in drawing RAM 260.

Microprocessor 222 is controlled by a pluraity of software routines which are used to initialize the system and to detect pinfall via manipulation of the image in image RAM 258. These software routines can be divided into five major sections: initialization, communication, major state control, window definition and window evaluation.

The initialization routines are used to initialize VDC 256 to define important characteristics such as video camera raster size, camera resolution and video display refresh rate. In addition, the routines are also used to define areas in RAM 246 which store pin location addresses, pin counts and threshold values. Finally, the initialization routines are used to set up control parameters for the communication buffers and communication protocol specifications for communication between microprocessor 222 and an external device via the serial communication port 226. These routines are straightforward and will not be discussed further herein.

The communication software routines handle the actual communication protocol with external devices over the external communication line 228. These routines store incoming data, check incoming data for errors and request retransmission if errors are found. The routines also format outgoing data and generate error checking codes to insure correct data reception by external devices.

The state control software routines control I/O decode circuit 248 to generate enable signals which define the major modes of operation of the system. These modes include viewing a real-time digitized picture generated by A/D converter 208, capturing an image received from the camera 200 in RAM 258, viewing an image stored in RAM 258 and viewing a stored image with an overlay of boxes or windows provided by drawing RAM 260.

The window location software routine is used to generate the boxes or windows which define areas of interest centered on each pin.

Finally, evaluation software is used to process the digital image to determine the number of pins that are standing on the pin deck. Conventional digital image processing routines could be used which logically combine digital signals from different areas of the image to eliminate background information and to highlight the pin images. Such processing routines may also be used to combine multiple images if more than one camera is used to view the pins. However, a simpler and faster approach is used with the preferred embodiment. More specifically, the window evaluation software routine tests and counts each of the pixels that lie within a particular window area to determine whether or not a pin is standing in the area defined by the window. The operation of each of these software routines will become clearer as described below during the operation of the pin spotting apparatus.

More particularly, the first operation which must be performed by the apparatus and the controlling software is the initialization routine to calibrate the system. In order to do this, installation personnel focus camera 200 on the pin deck containing a complete array of pins. During this focussing process, state control software routine may be run to display a real-time digitized picture on video display monitor 264 from camera 200 by converting the camera analog signal to a digital signal, via converter 208, and reconverting the digital signal to an analog signal via converter 262 so that camera 200 can be properly aligned to the pin deck.

After the camera has been initially aligned, the software enters the "capture image" mode. This mode may also be triggered by a pin spotter signal provided over lead 230 to the interrupt input of microprocessor 222 or by a communications line command which is provided from an external device via the serial communication port 226. In the capture image routine, the video display controller 256 waits for the start of a video frame and then signals analog-to-digital converter 208 to start conversion of the analog values of the pixels on each scan line. The digitized image pixels are then stored, via bus 270, in image RAM 258. Once initiated, the image capture operation is carried out autonomously by video display controller 256 and stops when one frame has been stored or captured in image RAM 258.

At this point during the initialization process, the stored image may be viewed by the user. To do this, microprocessor 222 commands VDC 256 to read the stored pixels from RAM 258 and pass them through digital-to-analog converter 262 to generate an analog signal for presentation on video display monitor 264.

Figure 3:
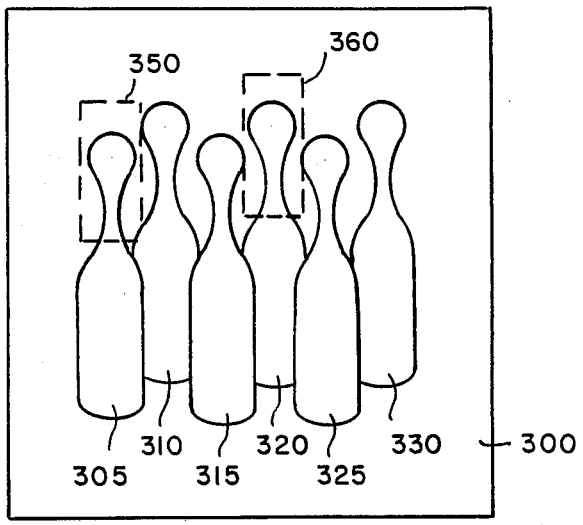
FIG. 3 is a pictorial representation of a monitor screen showing standing pins and the placement of the pin window boxes during system calibration.

The digitized pin deck image may then be "overlaid" or combined with one or more video window cursors in the shape of rectangular boxes which are used to define pin location areas. The digital information defining the boxes is stored in drawing RAM 260. FIG. 3 shows a sketch of a digitized screen display showing seven pins (305–330) located on the pin deck. Obviously, a full array of pins would comprise additional pins, however, these have been omitted for clarity.

Two cursor windows are schematically shown (windows 350 and 360) in FIG. 3 and either single or multiple windows may be displayed at one time. In addition, under control of microprocessor 222, the size and location of the cursor windows can be changed so that the windows can be maneuvered by the system operator over an area occupied by a particular pin.

Each window is defined by horizontal and vertical coordinates and size variables stored in RAM 246 which variables can be directly translated into memory addresses in both the image RAM 258 and the drawing RAM 260. More particularly, four values—a horizontal and a vertical starting coordinate (defining the location of one corner of the box), a height variable and a width variable define the location and size of each window. Each pin has a distinct set of addresses in memory called a pin array area where its corresponding window information is stored. Also stored with the window information for each pin are two additional numbers. The first of these numbers is a threshold number which is used (as discussed further herein) to evaluate the value of each of the pixels located within a window area. The final number is a "cutoff" value which is used to evaluate whether a pin is present or absent.

Software routines within the microprocessor 222 allow movement of the windows within the video picture. Such a routine may use keys or other input devices associated with an input terminal which communicate with microprocessor 222 via serial communication port 226. Input values obtained from port 226 may be used to change the horizontal and vertical starting coordinates or the height and width of the window.

After the windows have been defined during the initialization procedure and an image has been captured, a window evaluation routine makes a determination of whether a pin is present in the defined window area for each pin. The window evaluation routine begins after a predetermined delay following the pin count signal received over lead 230 (the predetermined delay allows for pins to fall or stabilize).

At the end of the delay period, microprocessor 222 commands video display controller 256 to take a video "snapshot" of the pin deck. This snapshot is a pin image developed over a time period of one video frame and the resulting pixels are stored in image RAM 258. After the pin image has been stored, the starting coordinate and size numbers corresponding to the first window area are read from RAM 246. From these numbers, microprocessor 222 computes image RAM addresses corresponding to pixel locations that fall within the predefined window. The memory locations corresponding to the computed addresses are then sequentially examined to determine if they contain a pixel value which exceeds the predetermined threshold. If the total number of pixel values exceeding the predetermined threshold is greater than a predetermined "cutoff" number, then the microprocessor deems a pin to be standing within the window area. Conversely, if the number of pixels having a value above the predetermined threshold is less than the "cutoff" value, then the microprocessor deems the the window area to be empty.

After window areas corresponding to all of the pins have been evaluated, the total pin count is sent by microprocessor 222 over serial communication port 226 to scoring apparatus or a host computer system.

Figure 4:
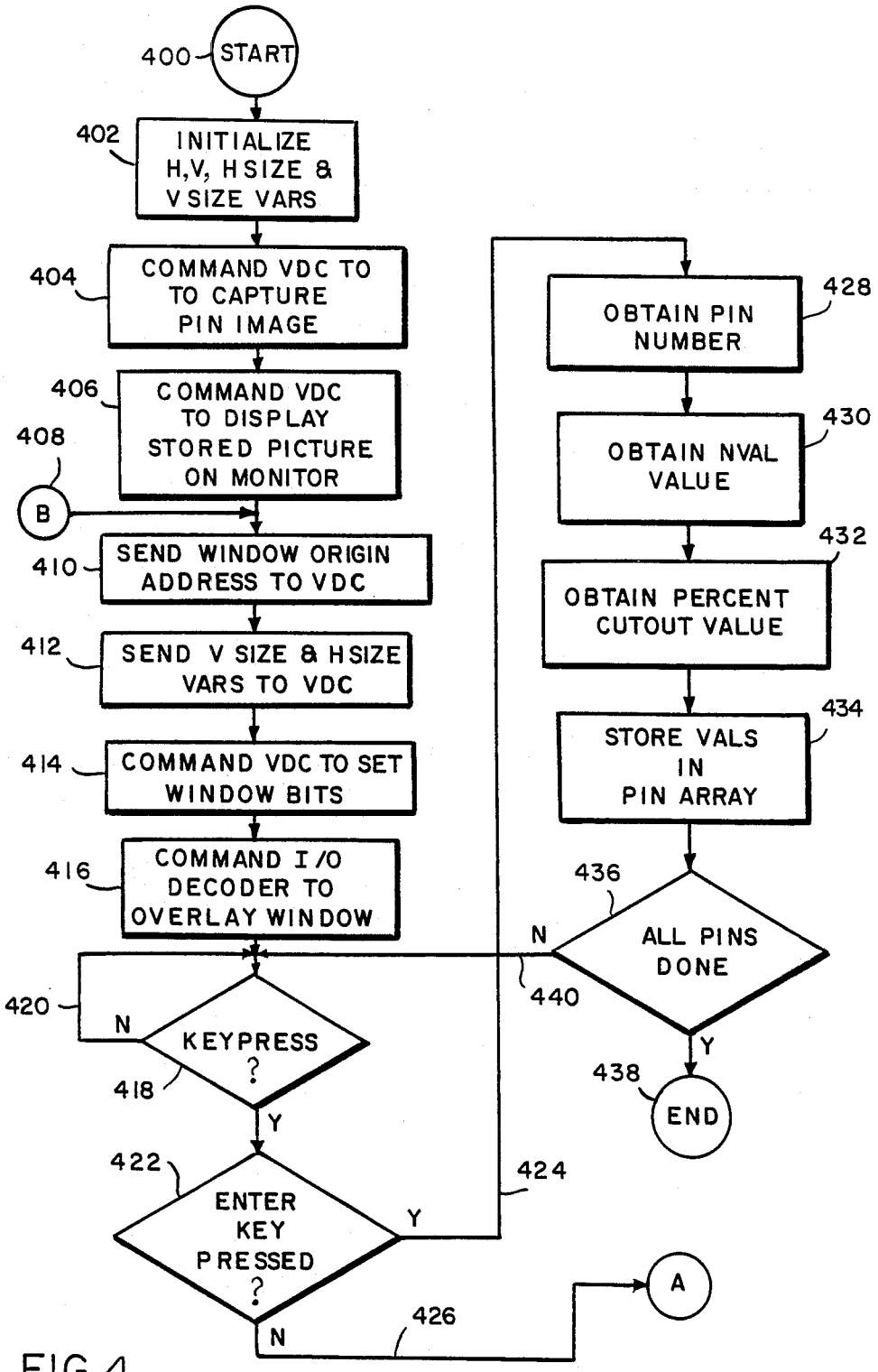
FIG. 4 is a simplified flow chart of an illustrative initialization routine.
Figure 5:
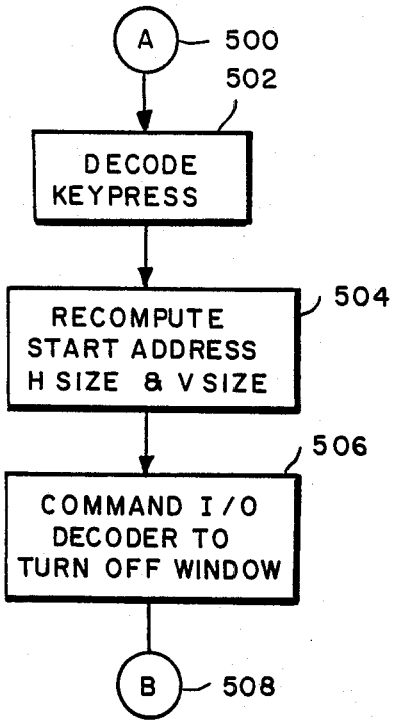
FIG. 5 is a simplified flow chart of a continuation of the illustrative initialization routine shown in FIG. 4.

More specifically, a functional flow chart of the window definition routine is shown in FIGS. 4 and 5. In FIG. 4 the routine starts at step 400 and proceeds to step 402 in which microprocessor 222 initializes the variables dealing with the window size and RAM 246. These variables consist of the "H" and "V" variables which define the originating box corner and the "HSIZE" and "VSIZE" variables which define the width and height of the box, respectively.

The routine then proceeds to step 404 in which microprocessor 222 commands video display controller 256 to capture the pin deck image by means of commands passed from processor 222 to controller 256 over address and data buses 232 and 234.

After the pin deck image has been captured, in step 406, microprocessor 222 commands VDC 256 to display the stored picture on monitor 264 (as previously described).

In step 410, microprocessor 222 computes an actual window origin address in RAM 260 from the origin variables H and V and sends the window origin address to VDC 256.

In step 412, the variables VSIZE and HSIZE are sent to VDC 256 and, in step 414, microprocessor 222 sends additional commands to VDC 256 causing it to set the locations in RAM 260 corresponding to window bits to logical "ones". As previously described, except for the origin address (which is calculated by microprocessor 222), VDC 256 automatically calculates the appropriate addresses from the variables HSIZE and VSIZE to generate the box cursor.

After the window bits have been set in the drawing RAM 260, microprocessor 222 commands I/O decoder 248 to enable register 263. As previously described, this action causes the set window bits in drawing RAM 260 to be transferred through register 263 to the white reference input of digital-to-analog converter 262. Consequently, the window bits are logically ORed with the image bits from image RAM 258 and a window or box image appears on video monitor 264.

Microprocessor 222 then monitors the serial communication port 226 for inputs, such as a keypress, from an external terminal indicating that the user wishes to change the location or size of the window box. This operation is carried out in step 418. If no keypress is detected, then the routine cycles, via path 420, through step 418 until a keypress is detected.

After a keypress is detected, the routine proceeds to step 422 in which it checks to see whether the enter key has been pressed. If the enter key has been pressed, (indicating that the window location and size are satisfactory to the user) the routine proceeds, via path 424, to step 428 in which it prompts the user at the remote terminal to enter a pin number, which pin number is transferred from the remote terminal over serial communication link 228 and serial communication port 226.

The routine then proceeds to step 430 in which the user is prompted to enter an additional value "NVAL". This latter number is the threshold value which determines whether a particular pixel value is to be considered as a "one" or "zero" (the pins are either white or colored and, thus, can be distinguished from the darker background. Since the image formed by camera 200 is black-and-white, a "one" corresponds to "light" area or a pin-intensity pixel and a "zero" corresponds to a black or background intensity pixel).

The routine then proceeds to step 432 in which the value "CUTOFF" is obtained. This value is a percentage of the total pixels which must be "ones" or pin-intensity pixels in order for the routine to deem a pin to be located at the position of the window.

After the pin number, NVAL and CUTOFF values have been obtained, in step 434, they are stored in RAM 246 in a pin "array" which is associated with the pin number obtained in step 428. It is also desirable that the initialization numbers be stored in a non-volatile memory such as PROM 240 (which may illustratively be an electrically-alterable ROM such as an EEPROM). If the parameters are stored in such a memory, the system need not be initialized in the event of a power failure or other temporary loss of power.

The routine then proceeds to step 436 in which it checks to see if windows have been defined for all pins. If so, the routine ends in step 438. If not, the routine proceeds, via path 440, to check for additional input at step 418. The operation proceeds in this manner until a window area has been defined for all pins.

Alternatively, in step 422, if the enter key was not pressed, the routine proceeds, via path 426, to point A and to the remainder of the routine shown on FIG. 5.

In FIG. 5, the routine proceeds from point A (step 500) and, in step 502, decodes the input information to determine which key was pressed or, alternatively, what action was requested.

Based on the key that was pressed or the action that was requested, in step 504, microprocessor 222 recomputes the starting address of the window or the height and width.

The routine then proceeds to step 506 in which microprocessor 222 commands I/O decoder 248 to disable register 263 which removes the window box from the pin deck image displayed on display unit 264. The routine then proceeds to point B (step 508, FIG. 5 and step 408 in FIG. 4) and then to step 410 in which the new window origin address is sent to the video display controller. The remaining steps are executed to display a new rectangle at the new position or size as dictated by the keypress or input detected.

Figure 6:
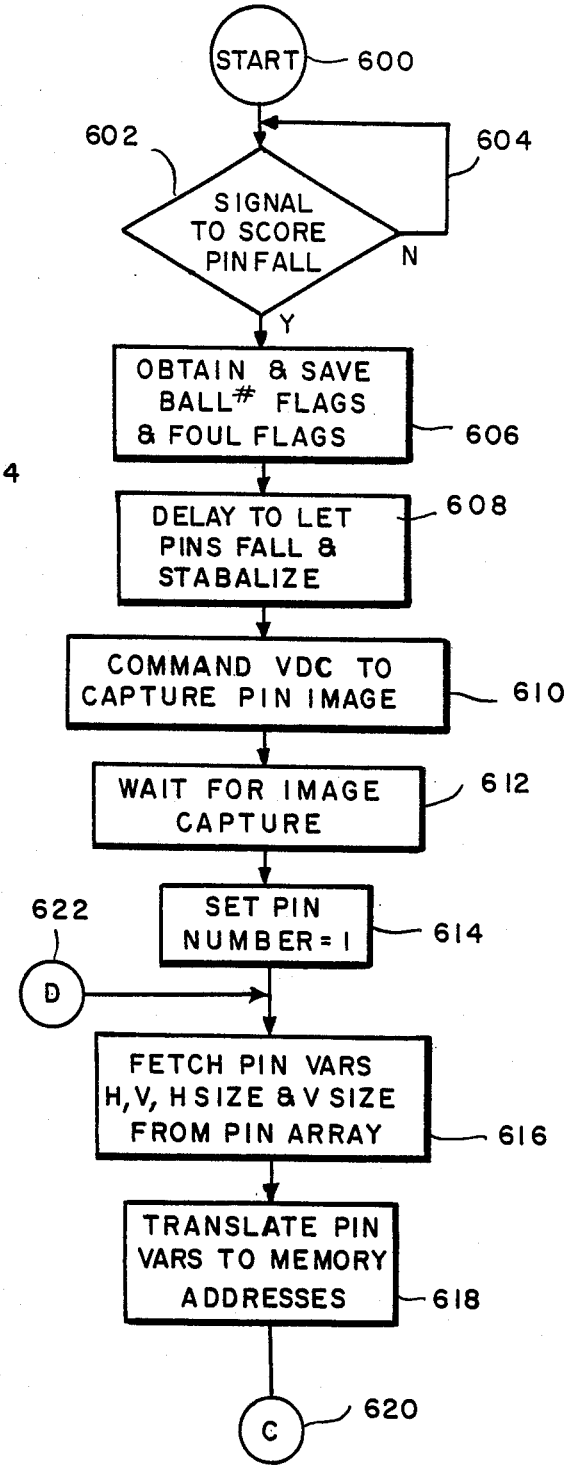
FIG. 6 is a simplified flow chart of an illustrative window evaluation routine.
Figure 7:
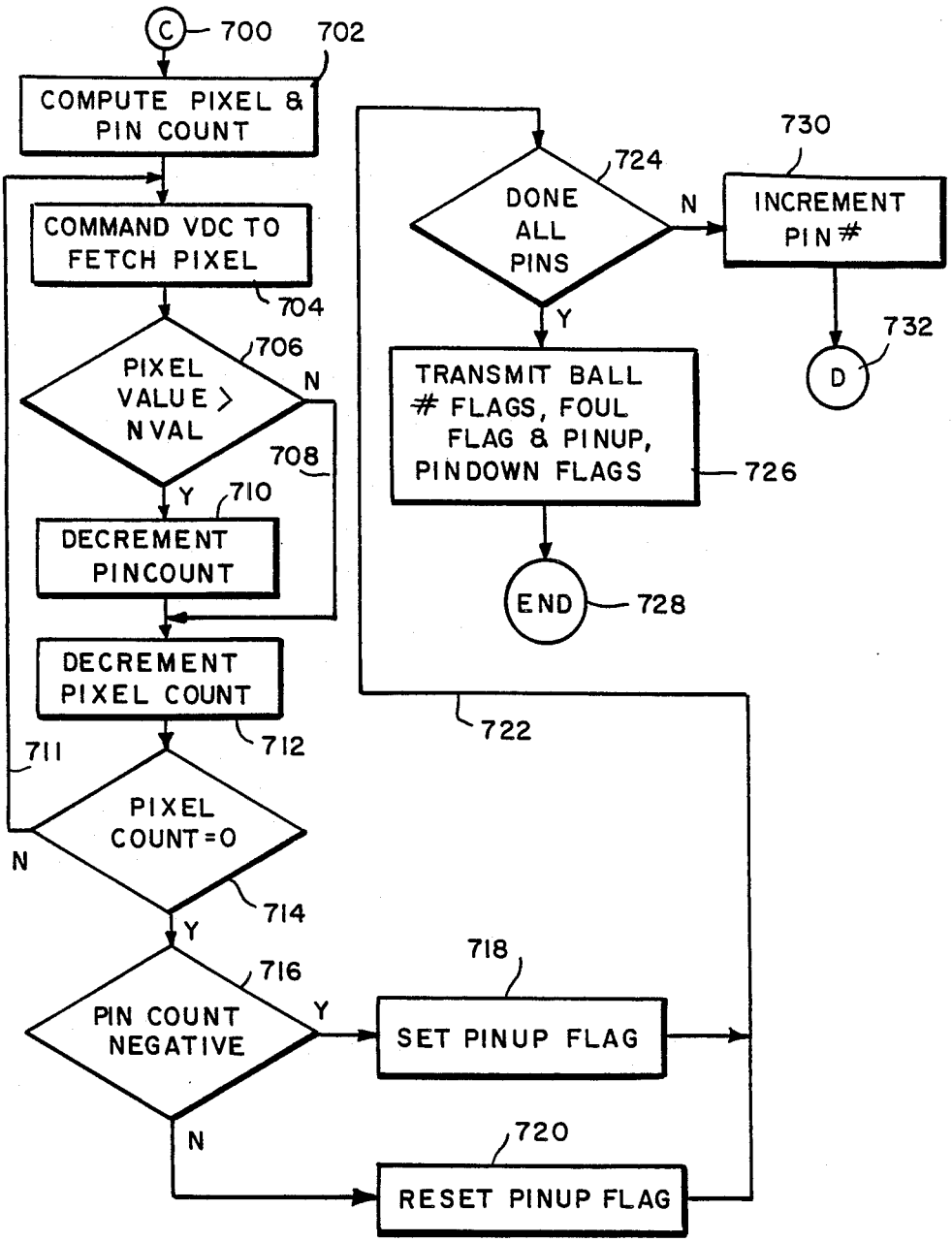
FIG. 7 is a simplified flow chart of a continuation of the illustrative window evaluation routine shown in FIG. 6.

FIGS. 6 and 7 disclose a functional block diagram of the software routine which determines pin count by processing the pin deck image.

In particular, the routine starts at step 600 in FIG. 6 and proceeds to step 602 in which microprocessor 222 monitors its interrupt input for a signal from the pin spotter system provided, via lead 230 (FIG. 2), to begin the pinfall scoring routine. If the signal is not detected, the routine repeats step 602, via path 604, until a pinfall scoring signal is detected.

Once such a signal is detected, the routine proceeds to step 606 in which it obtains, via lines 231 from the pin spotter equipment, flags pertaining to the ball number and fouls. In particular, these latter flags refer to whether the first ball or the second ball has been rolled and whether the player has committed a foul during the current frame. These flags are stored in memory 246 for later transmission to scoring equipment.

The routine then proceeds to step 608 in which an internal delay is implemented for approximately 2.5 seconds to allow the pins to fall or stabilize in position before the pin deck image is captured and processed. This time delay may be adjusted by appropriate software routines to allow for differences in performance times of different pin spotting machines.

After the pin stabilization delay, the routine proceeds to step 610 in which microprocessor 222 commands VDC 256, as previously described, to capture a pin deck image of the remaining pins. Also, as previously described, VDC 256 controls camera 200 and analog-to-digital converter 208 to generate such an image and store it in image RAM 258.

In step 612, an additional internal delay is built into the routine to allow time for all of the pixels in the complete pin deck image to be stored in RAM 258.

The routine then proceeds to step 614 in which the pin number is set equal to one so that the routine will process the window location of the first pin.

In step 616, the routine fetches the pin variables H, V, HSIZE, VSIZE, NVAL and CUTOFF which correspond to the pin number one from RAM 246.

In step 618, microprocessor 222 converts the pin variables into absolute memory addresses in image RAM 258 which addresses correspond to pixels that lie within the window which has been predefined for pin number one.

The routine then proceeds to point C (step 620 in FIG. 6 and step 700 in FIG. 7).

In FIG. 7, the routine proceeds to step 702 in which microprocessor 222 uses the variables HSIZE and VSIZE to compute the total pixel count of the pixels that lie within the predefined window for pin number 1. The pin count for pin number one is also calculated by multiplying the pixel count by the CUTOFF percentage.

In step 704, microprocessor 222 commands VDC 256 to fetch the first pixel from the address information previously computed in step 618.

In step 706, the pixel value obtained from VDC 256 is compared to the value NVAL obtained from RAM 246 in step 616. If the pixel value is greater than the value NVAL, the pixel is deemed to be a pin-intensity pixel. In this case the pin count value is decremented in step 710. Alternatively, if the pixel value is less than the NVAL threshold value, the routine proceeds via path 708 and bypasses step 710.

In step 712, the pixel count is decremented and, in step 714, the routine checks to see if the pixel count is equal to zero, indicating that all pixels have been processed. If not, the routine proceeds, via path 711, to step 704 in which VDC 256 is commanded to fetch the next pixel.

Alternatively, in step 714, if all the pixels have been processed, then the routine proceeds to step 716 in which the pin count value is checked to see whether it has become negative. If the pin count value has become negative, the total number of pin-intesity pixels exceeds the predetermined threshold for a pin to be deemed present in the predetermined window location. Thus, in step 718, the routine sets the pinup flag.

Alternatively, if the pin count value is not negative less than the required number of pin-intensity pixels were present in the predefined window location. In this case the routine proceeds to step 720 and resets the pinup flag to indicate that a pin has not been found in the predetermined location.

In either case, the routine proceeds, via path 722, to step 724 in which it checks to see if all pins have been processed. If not, the routine proceeds to step 730 in which it increments the pin number and then proceeds to point D (step 732 in FIG. 7, and step 622 in FIG. 6). From there, the routine fetches the new pin variables for the new pin number and proceeds to process the new pin location. The operation continues in this matter until all the pins have been processed.

If, in step 724, the routine determines that all pins have been processed, it proceeds to step 726 in which the ball number flags, foul flags and pinup flags are transmitted, via serial communication path 226, to a remote scoring unit or other device which utilizes the pin count information. The routine then ends at step 728.

Additional software routines (now shown) may be used to enhance system performance by displaying and evaluating multiple windows for each pin to more accurately spot the pins. In addition, to facilitate the spotting of pins which have moved away from their normal location but are still standing (off-spot pins) additional routines may be used to evaluate blank or empty windows located between normal pin positions. If a pin is spotted in one of these normally empty boxes and the pin is missing from its normal position then additional software algorithms can decide whether the pin has been moved.

What is claimed is:

1. Bowling pinfall detection apparatus for detecting the number of pins standing on a pin deck in response to a pinfall signal, said apparatus comprising video imaging apparatus, means responsive to said pinfall signal for controlling said video imaging apparatus to generate an output signal representing an image of the pins standing on said pin deck, means responsive to said video imaging apparatus output signal for converting said signal into digital signals, means for discriminating between digital signals representing pin-intensity pixels and digital signals representing background-intensity pixels, initiation means responsive to said digital signals for defining selected areas of said image for examination by said discriminating means, means for counting pin-intensity pixels within at least one of said selected areas to generate a pin count, and means responsive to said pin count and to a predetermined reference number for indicating a standing pin within said one of said selected areas when said pin count exceeds said reference number.

2. Bowling pinfall detection apparatus for detecting the number of pins standing on a pin deck in response to a pinfall signal and operator-generated signals, said apparatus comprising p1 video imaging apparatus, means responsive to said pinfall signal for controlling said video imaging apparatus to generate an output signal representing an image of the pins standing on said pin deck, analog-to-digital converter means responsive to said video imaging apparatus output signal for converting said signal into a plurality of digital signals, means responsive to said image signals for storing said signals, initialization means responsive to said operator-generated signals for defining selected areas of said image, means for discriminating between stored signals representing pin-intensity pixels and stored signals representing background-intensity pixels, means for counting stored signals representing pin-intensity pixels within one of said selected areas to generate a pin count, and means responsive to said pin count and to a predetermined reference number for indicating a pin standing on said pin deck.

3. Bowling pinfall detection apparatus according to claim 2 wherein said camera generates said output signal using ambient light to illuminate said pins.

4. Bowling pinfall detection apparatus according to claim 2 wherein said discriminating means comprises means responsive to said stored image signals and to a predetermined threshold value for comparing each of said stored image signals to said threshold value to determine the pin-intensity of each pixel.

5. Bowling pinfall detection apparatus according to claim 4 wherein said initialization means comprises means for visually displaying said stored image, and means for overlaying the displayed image with a video cursor and means responsive to said operator-generated signals for moving said cursor over said image to define selected areas of the image.

6. A method for detecting the number of bowling pins standing on a pin deck in response to a pinfall signal, said method comprising the steps of:

A. generating a plurality of digital image signals representing an image of said pin deck using ambient light to illuminate said pins, B. defining selected areas of said image, C. discriminating between digital image signals representing pin-intensity pixels and digital image signals representing background-intensity pixels, D. counting pin-intensity pixels within at least one of said selected areas to generate a pin count, and E. comparing said pin count to a predetermined reference number to indicate a standing pin when said pin count exceeds said reference number.

7. Bowling pinfall detection apparatus for detecting the number of pins standing on a pin deck, said apparatus comprising video imaging apparatus responsive to ambient light reflected from said pins for generating digital output signals representing the pins standing on said pin deck, means for discriminating between digital signals representing pin-intensity pixels and digital signals representing background-intensity pixels, initiation means responsive to said digital signals for defining selected areas of said image for examination by said discriminating means, means for counting pin-intensity pixels within at least one of said selected areas to generate a pin count, and means responsive to said pin count and to a predetermined reference number for indicating a standing pin within said one of said selected areas when said pin count exceeds said reference number.

8. Bowling pinfall detection apparatus for detecting the number of pins standing on a pin deck in response to a pinfall signal and operator-generated signals, said apparatus comprising at least one video camera, means responsive to said pinfall signal for controlling said camera to generate an analog output signal representing an image of the pins standing on said pin deck, and analog-to-digital converter means responsive to said camera output signal for converting said signal into a plurality of digital image signals, an image memory responsive to said image signals for storing said image signals, display means responsive to operator-generated signals for displaying said stored image, a drawing memory, means responsive to said operator-generated signals for generating digital cursor signals defining a cursor, means responsive to said curser signals for storing said cursor signals in said drawing memory, means responsive to said stored image signals and to said stored cursor signals for displaying an image of said pin deck overlaid with an image of said cursor so that said cursor defines selected areas of said image, means for storing parameters representing addresses in said image memory and said drawing memory corresponding to said selected areas of said image, means responsive to stored image signals for discriminating between image signals representing pin-intensity pixels and image signals representing background-intensity pixels, means responsive to said stored parameters for counting pin-intensity pixels within each of said selected areas to generate pin counts for each of said selected areas, and means responsive to said pin counts and to predetermined reference numbers for indicating a standing pin in one of said selected areas when said pin count for said one of said areas exceeds said reference number for said one of said areas.

9. Bowling pinfall detection apparatus according to claim 8 wherein said camera generates said output signal using ambient light to illuminate said pins.

10. Bowling pinfall detection apparatus according to claim 9 wherein said discriminating means comprises means responsive to said stored image signals and to a predetermined threshold value for comparing each of said stored image signals to said threshold value to determine the pin-intensity of each pixel.

11. Bowling pinfall detection apparatus according to claim 10 wherein said display means comprises a video display controller circuit and a monitor.

12. Bowling pinfall detection apparatus according to claim 11 wherein said means for displaying an image of said pin deck overlaid with an image of said cursor comprises means for logically ORing digital signals representing said image with digital signals representing said cursor.

* * * * *